United States Patent [19]

Faris

[11] Patent Number: 5,033,804

[45] Date of Patent: Jul. 23, 1991

[54] MULTIMEDIA WORKSTATION

[76] Inventor: Sadeg M. Faris, 24 Pocantico River Rd., Pleasantville, N.Y. 10570

[21] Appl. No.: 479,319

[22] Filed: Feb. 12, 1990

[51] Int. Cl.[5] ..... A47B 21/00

[52] U.S. Cl. ..... 312/208; 312/326; 312/7.2

[58] Field of Search ..... 312/7.1, 7.2, 326, 328, 312/208, 327

[56] References Cited

U.S. PATENT DOCUMENTS 4,669,789 6/1987 Pemberton ..... 312/208

4,766,422 8/1988 Wolters et al. ..... 312/208

*Primary Examiner*—Joseph Falk

*Attorney, Agent, or Firm*—Carl C. Kling

[57] ABSTRACT

This invention relates to office workstations, and particularly to a revolutionary electronic office workstation combining user access to communication, entertainment, record keeping, computation, environmental control, writing and miscellaneous functions. The workstation acts as a desk when viewscreen and keyboard are retracted and covered by a built-in retractable cover. When directed by embedded computer or manually, the workstation repositions the viewscreen to a preselected operational attitude. The operational attitude may vary between horizontal and slightly past vertical. The workstation includes embedded appliances such as copier, printer, facsimile, personal computer and future optional appliance connections, with central control unit and buses for power, data, communications, control and other functions. Embedded appliances do not require individual covers or individual power supplies, and accordingly there is no maze of cables in view. Interconnecting buses make internal cable connections simple, inexpensive and straightforward. The workstation comprises a fuselage unit which provides shared support for appliances, from a universal power coverter and a control microprocessor. The fuselage also provides gravity support for wings and appended appliance modules which are supported physically and electrically. There is a lock system for activating a selection of appliances authorized for the particular user. There is a workstation control program and provision for a user personalization program.

31 Claims, 10 Drawing Sheets

Fig.4
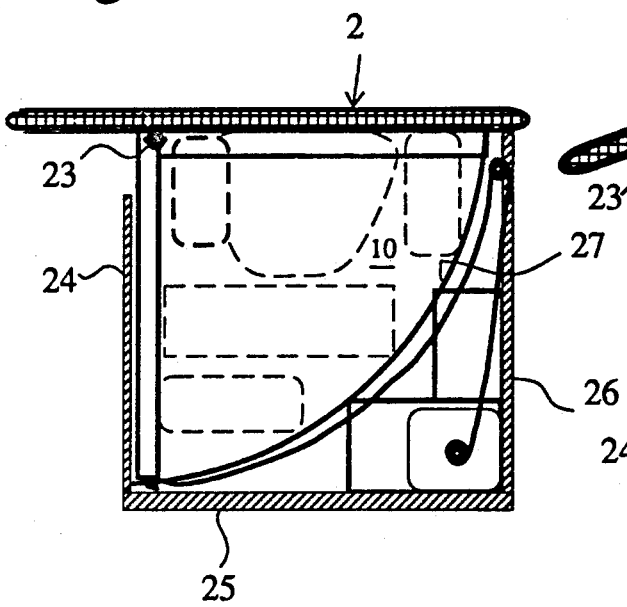
Fig. 5
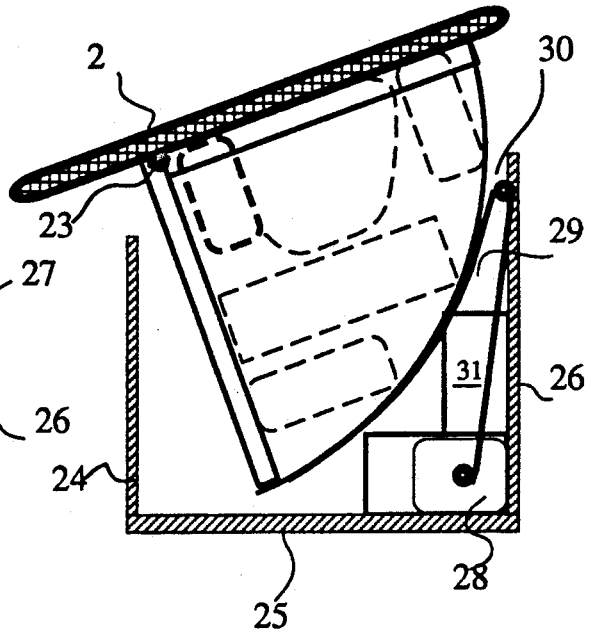
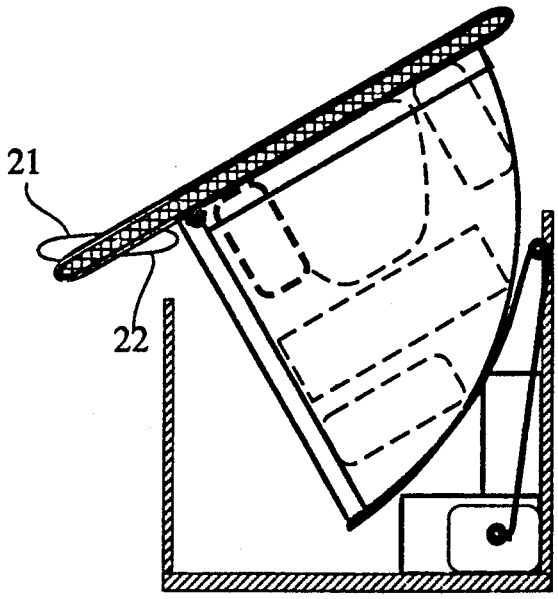
Fig. 6

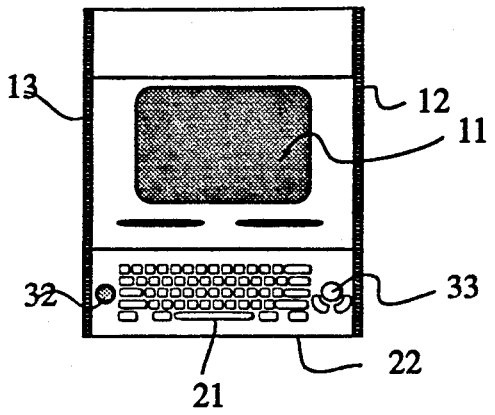
Fig.7
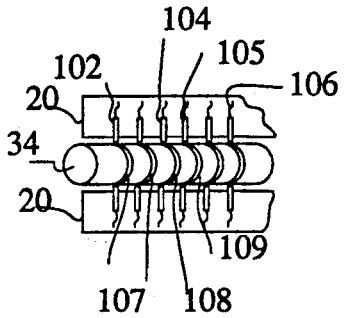
Fig. 8
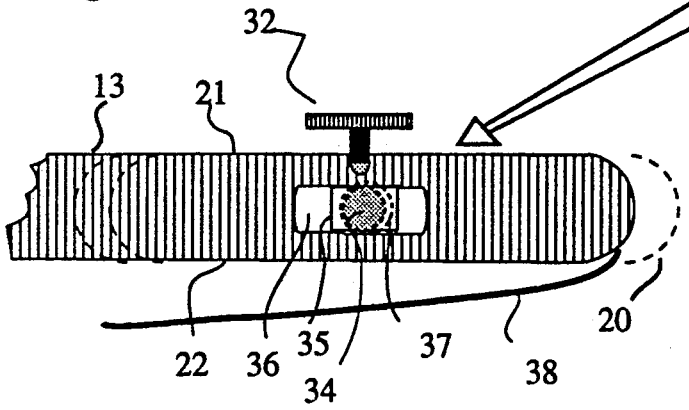
Fig. 9
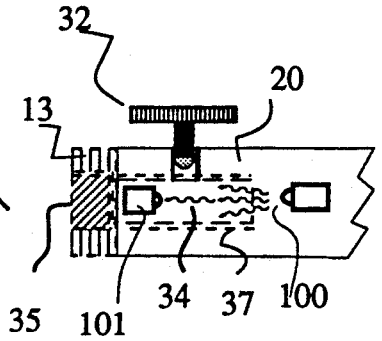
Fig.10
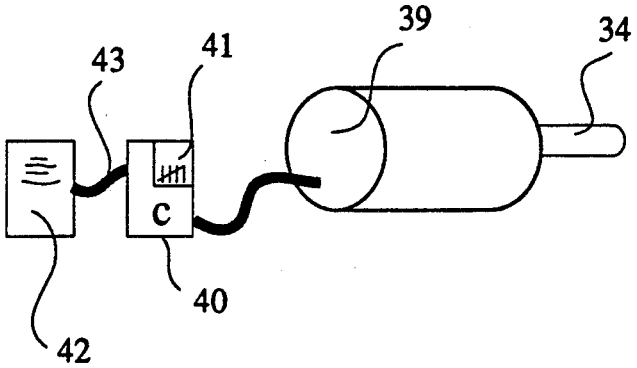

Fig. 11
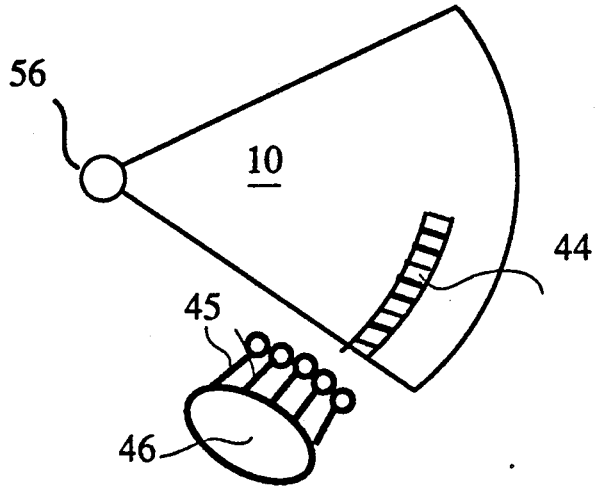
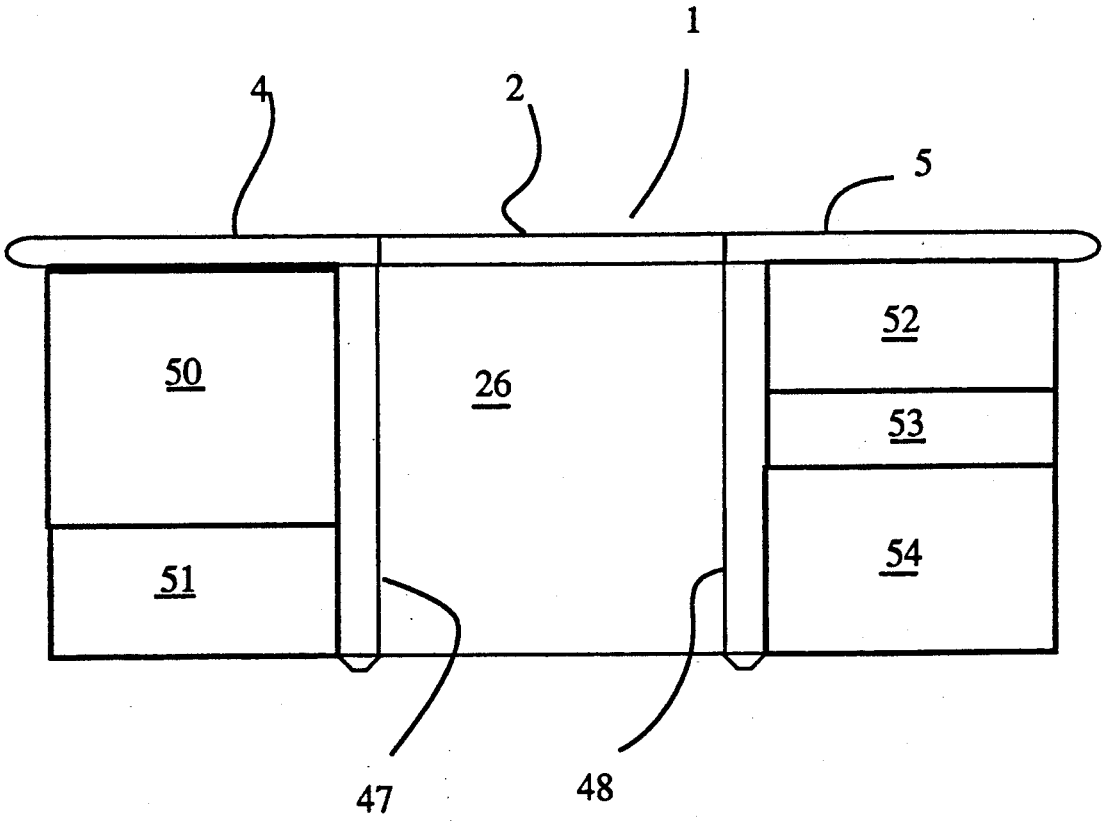
Fig. 12

Fig. 15
[topview]
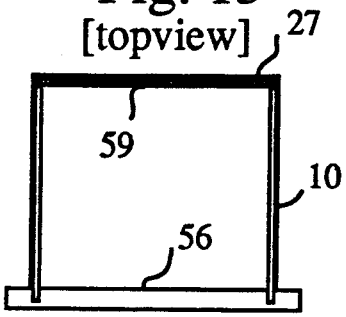
Fig. 16
[frontview]
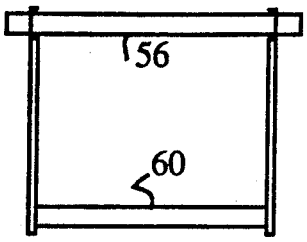
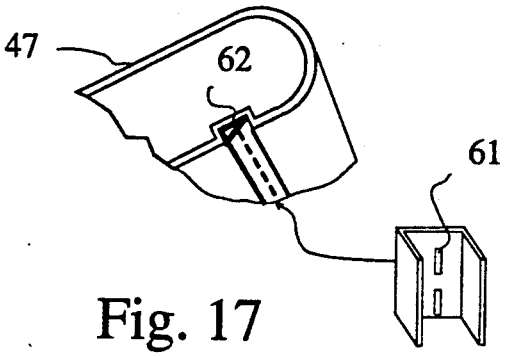
Fig. 17
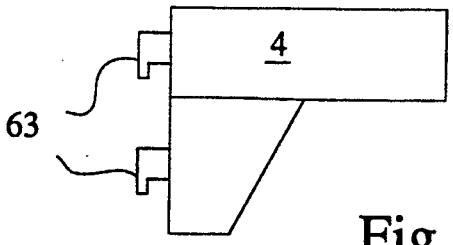
Fig. 18
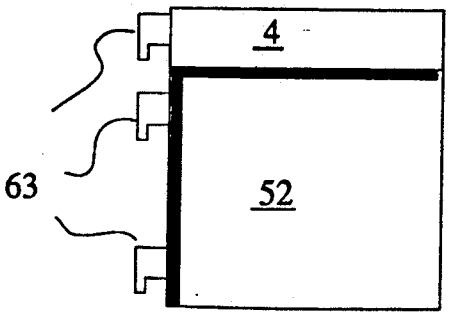
Fig.19

Fig. 20
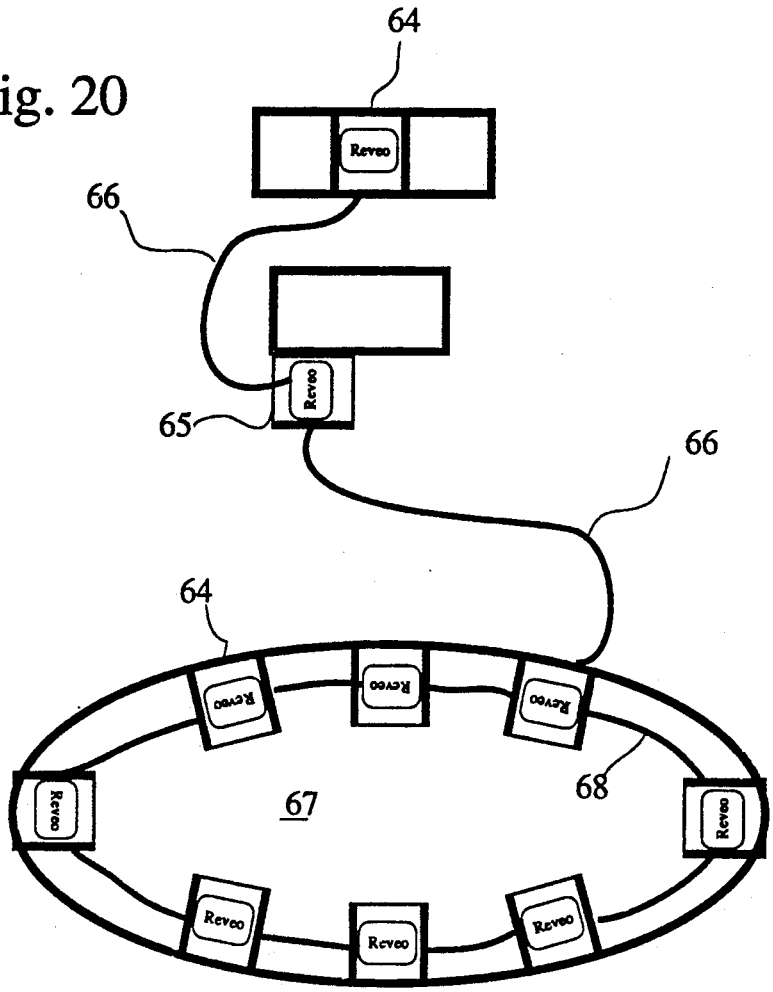
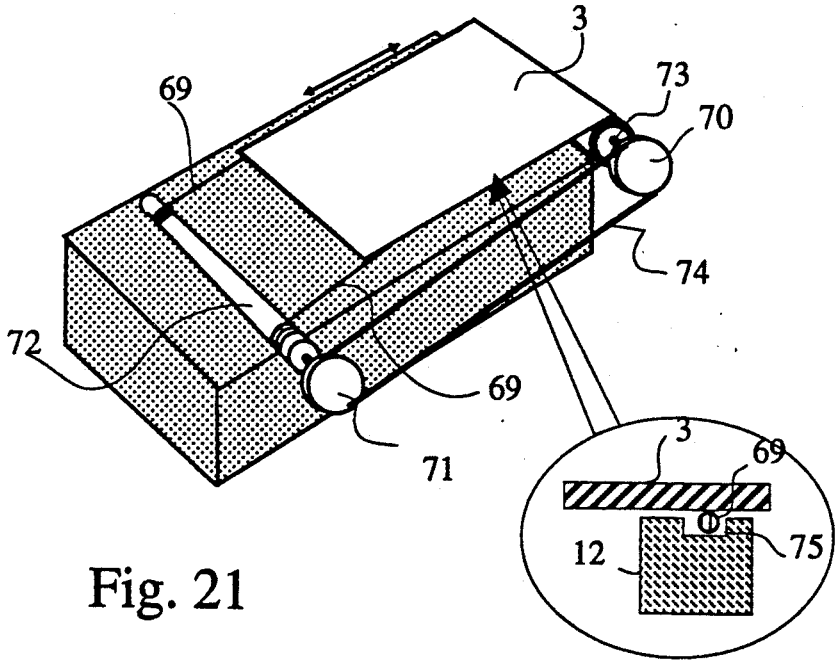
Fig. 21

MULTIMEDIA WORKSTATION

BACKGROUND OF THE INVENTION

1. Field of the Invention

This invention relates to office and entertainment equipment and furniture, and particularly relates to a revolutionary electronic office multimedia workstation combining capability for convenient and comfortable access to communication, entertainment, record keeping, computation and desktop activity such as writing.

2. Description of Related Art

Multimedia processing is the ability to manipulate and to merge audio, video, graphics and text. The microelectronics revolution is making universal such table-top appliances as copiers, personal computers, printers and facsimile, in addition to the more traditional desk-top writing space, writing equipment and telephone. The ease of use and the durability of these appliances, as well as the current relatively low cost, makes it possible for a great variety of users to operate these appliances personally. For the office worker, and for the secretary perhaps, heavy-duty appliances standing alone, or individual appliances arrayed on a table-top and individually connected for power and communication, might be accepatable. But for the user whose office decor must be top quality, and for all users for whom space is at a premium, and whose time and comfort are important, there is a need for an effective compact multi-appliance workstation. This workstation not only must include a great variety of functional capability, but also must be both comfortable and impressive as an item of furniture. Furthermore, it may be advantageous for the workstation to be located out into the room, away from any wall. Connecting cables and power cables for individual appliances thus would create visual clutter and even a possible hazard. The cost of a full set of individual appliances, each with power converter and full covers, plus the cost of tables to support the set of appliances, is considerable. It is a very difficult decorating problem to integrate a number of appliances, each with its own size, shape and color scheme and requisite cables, with walls, desk, chair and artistic items.

The prior art includes also a computer workstation built into an antique-style rolltop desk, with viewscreen and printer mounted permanently in operational position, accessible for use when the roller top is opened, and with keyboard in a position for use, but under a movable worktop.

The prior art thus has provided the user with a set of office appliances partially or not at all integrated into the workstation, and has partially or not at all solved the problems of such integration. Full advantage of the available economies has not been taken.

The prior art has produced a variety of video cabinets and computer workstations. Typically, however, these cabinets and workstations have featured a single appliance to be carried atop a shelf or built in. Furniture makers have made furniture with worktops or shelves to hold appliances. Appliance makers have made complete appliances, each with a full complement of covers, power supplies, cables and other essentials.

A different approach was originally taken by stereo component makers, who sold subunits which the user would mount on shelves and integrate electronically, most commonly in a stack of shelves.

The office environment generally involves:

1. office workers, such as secretaries, managers, etc., who may collectively be referred to as "users" of office appliances and furniture.
2. office furniture.
3. office appliances, such as typewriters, communication equipment such as telephone, facsimile, dictating machines, information storage devices ranging from address card devices and file cabinets to large computer systems. The large crew-served central computer system with its own assigned space still exists, but the personal computer has found its place in the office and in the home, either as a "smart terminal" supplement to the large computer system or as a complete system in itself, with its own keyboard, disk drives, computation unit and printer.
4. office design, including arrangement of office furniture and office appliances, placement of office workers, and decor.

Office capability has experienced revolutionary transformation as office workers became the users of computers and other sophisticated small office appliances. Users in the small office, even in the home, gained productivity previously limited to the large corporation with its costly mainframe computers and banks of peripheral units such as storage devices and printers. This productivity gain has been referred to as the "desktop revolution." The desktop revolution has not, however, been without its drawbacks. One such drawback is the hitherto unchecked proliferation of desktop and tabletop devices. This proliferation is the source of a new problem, which may be referred to as "office environment pollution."

Office environment pollution creates a set of problems which affect office workers, office furniture, office appliances, and office design. Office environment pollution may affect the health and morale of the office worker and thus diminish productivity. Office environment pollution may create clutter and require additional desks and auxiliary tables, demanding additional office furniture just for the proliferating office appliances, including additional power cables, communication cables, over-voltage protectors, which might be thought of as appliances demanding additional appliances. Cable clutter is very significant; the ordinary office cannot take the solution found in most large computer installations-the raised floor with cables underneath. Office environment pollution has a terrible effect on office design.

Computer stands have been designed and marketed. These tend to be multiple-level tables, having fixed locations for the various appliances which make up a personal computer system. Some computer stands permit installation of the display screen at an angle to the horizontal and vertical. Various secretarial workstations have been provided, ranging from the simple typewriter table to the disappearing typewriter desk, in which a desktop conceals the mechanism to raise a typewriter to operating position or to lower it to concealment below the desktop.

The need exists for an ergonomically and aesthetically appealing multimedia workstation which is economically competitive to the array of individual appliances and their supporting equipment and furniture. User health is an important consideration; eyestrain and backstrain are to be avoided. The workstation must minimize harmful radiation from the appliances, and must provide a comfortable worktop, a comfortable keyboard, and comfortable viewing of any viewscreen, plus reachable storage and appliance access.

The office appliance industry has been fragmented. It has grown separately for each appliance. While not a universal situation, it is common for copier manufacturers to make copiers, facsimile manufacturers to make facsimile, and so on with manufacturers of telephone answering machines, telephone instruments, dictating machines, computers, etc. The office furniture industry has also grown separately. Desk manufacturers have made provision for the typewriter, in secretary desk units, and at least one manufacturer offers a computer in a rolltop desk, but other appliances have generally been table-top appliances. A noable exception is the single-purpose workstation such as the reservation terminal. It is very unusual to have such an appliance placed on the desk of a generalist; it is very very unusual to have such an appliance built into the general-purpose desk.

U.S. Pat. No. 4,669,789, Pemberton, COMPUTER USER'S DESK, June 2, 1987, shows a desk with a liftable worktop which carries a viewscreen mounted underneath. The entire computer, including keyboard, is covered by the worktop in desk mode. In computer mode, the worktop is raised to raise and unmask the viewscreen; the keyboard support slides out into operational position.

U.S. Pat. No. 4,766,422, Wolters et al, COMPUTER INTEGRATED DESK, Aug. 23, 1988, shows a desk which in desk mode appears to be a standard executive kneehole desk, with sides having either tambour door or hinged door to unmask computer components built into the desk. The viewscreen is of the flat screen variety and slides vertically upward from a rest position at the rear of the desk out of sight. The keyboard is raised from a retracted position below the worktop blotter pad when in computer mode.

In short, those skilled in the office furniture art have avoided the office appliance arts; those skilled in a selected office appliance art have not been skilled in the art of office furniture, or even the art of other office appliances. There has been little effort and small success in supplying to a generalist user an integrated general purpose workstation with a meaningful set of the currently available major office appliances. It is unheard of to supply an integrated workstation with provision for easy acceptance of a future designed appliance as an integral built-in part of the system, on a basis other than provision of table-top or equivalent space. The need is for a REVolutionary Electronic Office, which may be termed a "reveo."

SUMMARY OF THE INVENTION

The object of the invention is to provide a visually appealing, comfortable reveo with comfortable access to appliances.

A feature of the invention is a desktop which includes retractable viewscreen basket and retractable keyboard box, which may be totally retracted to establish a writing worktop, and which may be extended through a wide range of attitudes for convenient viewing of the screen and access to the keyboard.

A subfeature of the invention is the establishment of preset positions to which the viewscreen basket may be extended and to which the keyboard may be positioned.

Another subfeature of the invention is structure alleviating health concerns related to back, neck, wrist and eye strains by means of adjustable viewscreen and adjustable keyboard.

Another subfeature of the invention is a repositionable viewscreen top cover which may be extended for desktop activities, and which may be retracted to provide access to keyboard and viewscreen.

Another feature of the invention is a plural-degree-of-freedom sliding pivot for the keyboard, which allows easy positioning as part of the desktop or as active keyboard.

A feature of the invention is shielding of the user from low frequency radiation as well as from high frequency radiation, using the skin of the workstation as both strength member and shield member, alleviating concerns associated with long-term exposure to the very low level, probably harmless radiation emitted by office appliances and their connections.

Another feature of the invention is a lock system which conveniently determines a subset of appliances which are made accessible, and a subset of appliances which are made electrically available to the user depending upon authorization.

Another feature of the invention is a fuselage unit, with gravity support, power support, signal support and control, with provision for adding built-in appliances of varying sizes and configurations.

An advantage of the invention is that a great number of appliances are accommodated within the workstation, both inside and outside the fuselage, eliminating many individual covers, power converters, armored cables, connectors, etc., taking advantage of modularity designed and built into the workstation.

Another advantage of the invention is its multimedia capability, in which most functions can be accessed while the user remains seated or at most within a few steps, and in many cases performing two or even more functions simultaneaously.

Another advantage of the invention is the modularity which makes possible easy alteration in the population of appliances, together with the easy access for servicing.

Other objects, features and advantages of the invention, including the capability of accepting newly developed appliances, either supplementing an existing appliance or supplanting an obsolescent appliance, will be apparent from the following description of the preferred embodiments.

BRIEF DESCRIPTION OF THE DRAWINGS

FIGS. 4, 5 and 6 form a composite presentation of the viewscreen basket and mechanisms for extending and retracting the viewscreen basket, for supporting the keyboard, and for supporting some of the various appliances making up the workstation. FIG. 4 shows the viewscreen and keyboard out of play, with worktop at maximum area and horizontal. FIG. 5 shows the viewscreen basket being extended to an angle position. FIG. 6 shows the keyboard being positioned for use. FIGS. 7, 8 and 9 are semidiagrammatic presentations of the preferred mechanism for establishing the keyboard in retracted position or, conversely, rotated and extended to a selected position and held positively in place.

FIGS. 10 and 11 are a semidiagrammatic presentation of a second preferred mechanism for determining the relative attitude of the keyboard box with respect to the viewscreen basket frame, and for moving the keyboard to a selected or preset position. FIG. 10 shows a preferred positioner for the keyboard box, a stepping motor and step counter. FIG. 11 shows a preferred position sensor for the viewscreen basket, a coded strip and set of reading photodiodes.

FIGS. 12–15 show details of modular construction of the system. FIG. 12 is a user view, a rear elevation view showing how wing modules are supported by the fuselage unit. FIG. 13, a plan view with worktop and wings shown as transparent, shows basic structure of fuselage and wings. FIG. 14, a plan view with worktop and winps omitted and with keyboard, wings, under-wing modules and viewscreen basket omitted, shows structural details of the fuselage unit.

FIGS. 15–19 show details of frame and skin construction of the viewscreen basket. FIG. 15 shows details at top of the viewscreen basket. FIG. 16 shows details at bottom of the viewscreen basket. FIG. 17 shows how a slotted U-channel, to support wings and module boxes, is integrated into the fuselage. FIG. 18 shows how a wing may be carried on the U-channel. FIG. 19 shows how a wing may be carried on a module box.

FIG. 20 is a composite diagram showing various wing configurations in plan view, schematically arranged in an interconnected communication network.

FIG. 21 is a semidiagrammatic isometric view showing details of the protective viewscreen top cover and its positioning mechanism.

DESCRIPTION OF THE PREFERRED EMBODIMENT

Figure 1:
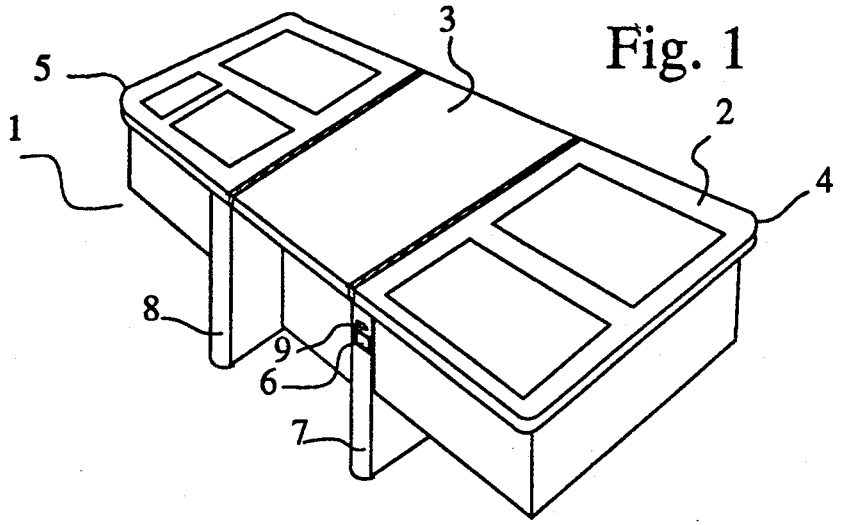
FIG. 1 is a perspective view of the reveo with the keyboard and viewscreen retracted to establish a worktop, and with viewscreen top cover extended over the viewscreen.

FIG. 1 shows the workstation 1 retracted to provide a worktop 2. This is the at-rest configuration for overnight. The user might be expected to take his seat, deal with whatever has been placed on the worktop since he left, and activate the reveo.

The user may prefer to use the worktop 2 for a time, and will clear at least the viewscreen top cover 3, possibly by moving things onto right wing 4 or left wing 5. The user will most likely want to review overnight electronic mail. The user in such case will want the viewscreen elevated to the attitude preselected for comfortable viewing and key-entry. The user opens appliance lock door 6 and unlocks and powers a selection of appliances. Details of lock and power controls will be described infra. The user causes the viewscreen top cover 3 to be retracted, details infra. The user may already be in cockpit position, standing, or sitting with knees between right tower door 7 and left tower door 8. The mechanisms behind the tower doors may be storage items, or may be additional appliances, details infra. The user, once identified by the workstation as authorized, may release the appliance lock door 6 for further access as the key is removed from appliance lock door keylock 9.

Figure 2:
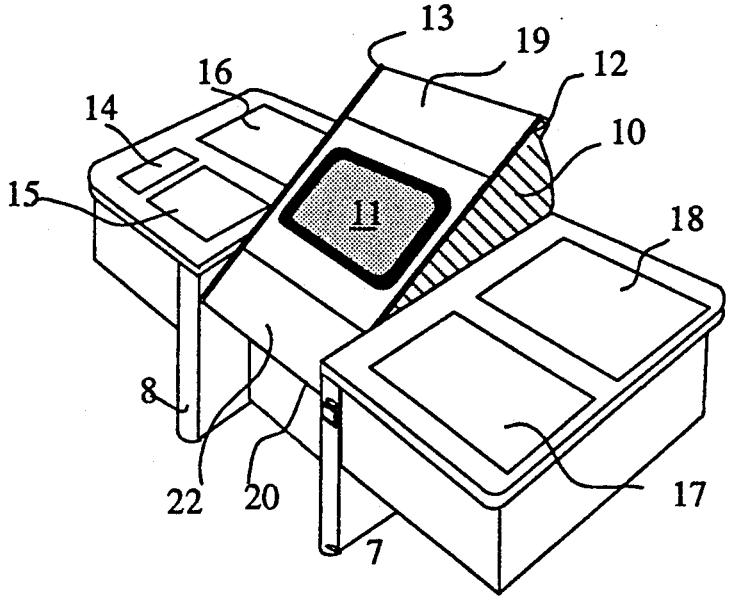
FIG. 2 is a perspective view of the reveo with the keyboard still retracted but with the viewscreen uncovered and extended to a selected operational attitude.

FIG. 2 shows viewscreen top cover 3 retracted, with viewscreen basket 10 uncovered and raised as a unit to a comfortable viewing attitude for the viewscreen 11, but with keyboard still retracted flat between viewscreen basket top frames 12 and 13. The user's personal program might be arranged to scan the electronic mail on the viewscreen while the user finishes clearing the worktop 2. Clearing worktop 2 permits access, if locks are properly set, to appliances under worktop appliance doors 14–19. A typical set of appliances and possible positions might be as shown on the following Typical Appliance Selection and Location Chart:

TYPICAL APPLIANCE SELECTION AND LOCATION CHART

| Appliance Door Number & Location | Appliance Name |
|---|---|
| 7. right tower | telephone handset, dictation microphone, speakerphone |
| 8. | power stapler, tape cassettes |
| 14. | stereo disk unit |
| 15. | video disk unit |
| 16. | facsimile |
| 17. | copier |
| 18. | printer |
| 19. | stereo controls, storage for cassettes and disks, storage for desk accessories such as stapler, sticky tape, etc. |

The user's personal program may provide soothing music on the stereo while the user views electronic mail and simultaneously reviews fax documents—personal multitasking. The user's personal program may simultaneously be set to record or reroute phone calls at this time—or to squelch the stereo and turn on the speakerphone. At least for purposes of this description, the user completes these activities and is ready for the keyboard. The user signals this readiness, or the user's profile, which includes controls for the user's startup program, checks for a clear viewscreen top to authorize a change of viewscreen basket position, and controls repositioning to the user's selected or preset position, details infra.

Figure 3:
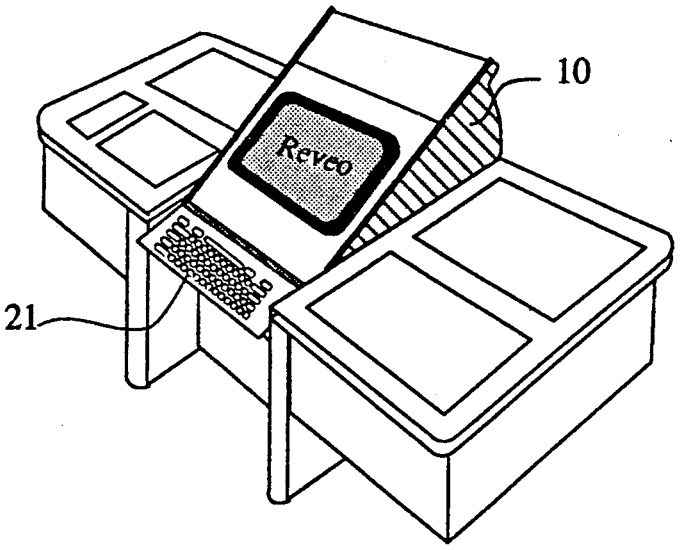
FIG. 3 is a perspective view of the reveo with the viewscreen basket extended to a selected or preset operational attitude, and with the keyboard positioned for use, also at a selected or preset operational attitude.

FIG. 3 shows the viewscreen basket 10 raised as a unit to a comfortable viewing attitude for the user. Viewscreen 11, with keyboard box 20 rotated for access and positioned for comfortable keying of keyboard 21, is moved to preset or selected interactive keying position for the user.

FIGS. 4–6 show fuselage parts 23–26, which support and shield the viewscreen basket 10. Right viewscreen basket pivot 23 provides support for the viewscreen basket 10. Kneehole back exoskeleton 24 provides shielding for the user and forms a backstop for the viewscreen basket 10 when fully retracted. Fuselage base 25 and fuselage back exoskeleton 26 also provide support and shielding. Mechanism 27–30 carries out the function of extending the viewscreen basket 10. The extending means includes the arcuate viewscreen basket back panel 27, motor 28, basket positioning belt 29, and pulley 30. The viewscreen basket pivots on two pivots, of which right pivot 23 shows in FIG. 5. Shared appliance support box 31 holds shared appliance support items such as a computer and a universal power supply.

The operation of the extending mechanism may follow several modes including manual mode, preset mode, keyset mode, and set mode. In manual mode, the executive pushes the extend/retract button which causes operation opposite the previous operation as indicated by an electronic toggle. To reverse, the user merely lifts a finger off the extend/retract button and depresses the button again to operate the extension mechanism until the viewscreen attitude is acceptable.

In preset mode, the user, once identified, may order "extend to preset position" in whatever code the user has set into the control computer, which is not shown in the figures being discussed. The control computer, which is preferably a microprocessor with certain built-in and certain programmable operations, will then order extend or retract to move the viewscreen from its current position to the preset position. (The control computer may take several forms and be located wherever convenient—see microprocessor 76 shown in FIG. 22, infra. The current position is indicated by a digital position readout collar on the pivot axle, or, alternatively, by a position readout decal on the side skin of the viewscreen basket, acting with a complementary readout scanner on the main frame.

In keyset mode, the user keys in the coordinate values for viewscreen and keyboard chosen for comfort, and orders extension from the keyboard, after which the computer takes over as in preset mode. Viewscreen 11 may be a cathode ray tube or, preferably, a flat panel display.

In set mode, the user orders the computer to remember the coordinate values current at the comfortable viewing position, after which preset mode may be used.

FIGS. 7–9 show the preferred means 21–30 for positioning the keyboard 21, which includes manual keyboard detent lockscrew 32 and mouse 33. Keyboard box 20 turns on axle 34 which in turn is held in pivot slides 35. The user pulls the keyboard box 20 out on the slides 35 in slide slots 36, which action frees the keyboard box for rotation on axle 34. The user rotates the keyboard box 20 to the chosen rotational position and detents it in place with manual keyboard position lockscrew 32. The keyboard communication cable 38, or alternatively, an infra-red wireless communication mechanism, details infra, provides communication means between keyboard box 20 and other functional units of the system.

As an alternative embodiment, keyboard box 20 may be detented by an arc of shallow holes in the frames and a corresponding spring ball detent.

The keyboard box 20 in the preferred embodiment is manually positioned. As an alternative, FIG. 10 shows how the keyboard may be rotated by a stepping motor 39 a selected or preset position determined by control unit 40 and step counter 41. As a further alternative, a digitally readable position indicator, any one of many commercially available shaft encoders, may be arranged on axle 34 to be read by appropriate readout such as photodiodes mounted on one of the pivot slides 35. Note that the position-readout mechanism, of whatever technique, provides relative position, relative to the position of the worktop frames which hold them. This relative position, adjusted by the known rotational position of the desktop frame, may be recalled by a secretary or, preferably, by the computer, to make it convenient to set the keyboard and viewscreen for the user's comfort.

Ordinarily, the user will operate keyboard 21 and viewscreen 11 at the same time, and will have preset coordinate values in the computer to set both keyboard and viewscreen. However, since the keyboard support varies in attitude with variations in the attitude of the viewscreen, the keyboard may have to be adjusted with each adjustment of the viewscreen. A particular user may like a particular keyboard setting regardless of viewscreen attitude, that is, a "true" keyboard attitude rather than a "relative" attitude. The computer can easily keep track of this by manipulation of the digital value of the basket top frames 12, 13 (true) and the digital value of the coordinates at which the keyboard is positioned (relative). The computer uses viewscreen basket attitude determining means to indicate the true value of the attitude of the rotatable desktop frame, and stores this viewscreen attitude (or equivalent) coordinates digitally. The computer also uses keyboard box 20 relative attitude determining means to indicate the relative value of the rotation of the keyboard box 20 from the rotatable viewscreen basket worktop frames, and concatenates these two values to arrive at the true attitude value for the keyboard 21. For example, the rotatable viewscreen basket 10 may be set at +45 degrees (true, from the horizontal 0 degrees) and the keyboard box 20 may be set at −35 degrees relative. The user in the example looks diagonally downward at the viewscreen 11; the keyboard 21 in the example tilts down 10 degrees from the horizontal. Viewscreen 45 degrees true; keyboard 10 degrees true resulting from the −35 degrees relative.

FIG. 10 shows attitude control mechanism for keyboard box 20. Keyboard pivot axle 34 is driven by stepper motor 39 under control of step controller 40, which includes step counter 41. Power for the step controller 40 comes from a tap on universal power supply 42 via appliance bus 43.

FIG. 11 shows the preferred digital position readout for viewscreen basket 10, a coded decal 44, set of photodiodes 45, and digitizer 46. This has the advantage that it can be easily read by the user to check coordinates. A digital shaft encoder on axle 56 is an alternative; this readout may be presented on the viewscreen to check coordinates.

FIG. 12 shows support towers 47, 48 which include integral countersunk standard slotted U-channels (to be described infra in connection with FIG. 17) of the type used to support shelving, to support wings and modules. Support towers 47, 48 are of heavy-guage sheet steel for support and radiation shielding. The towers are hollow to permit installation of appropriately-configured appliances. The support towers 47, 48 provide gravity support for fuselage 49, of which they are integral parts, and support all other items in the preferred embodiment. If desired, additional gravity support may be derived from legs (not shown) to be located at outboard positions on wings 4, 5 or modules 50–54. Note that modules 50–54 may vary in volume.

Figure 13:
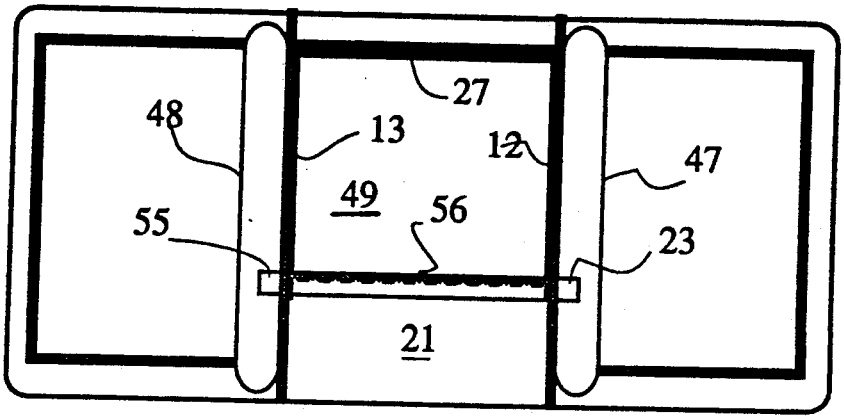
Figure 14:
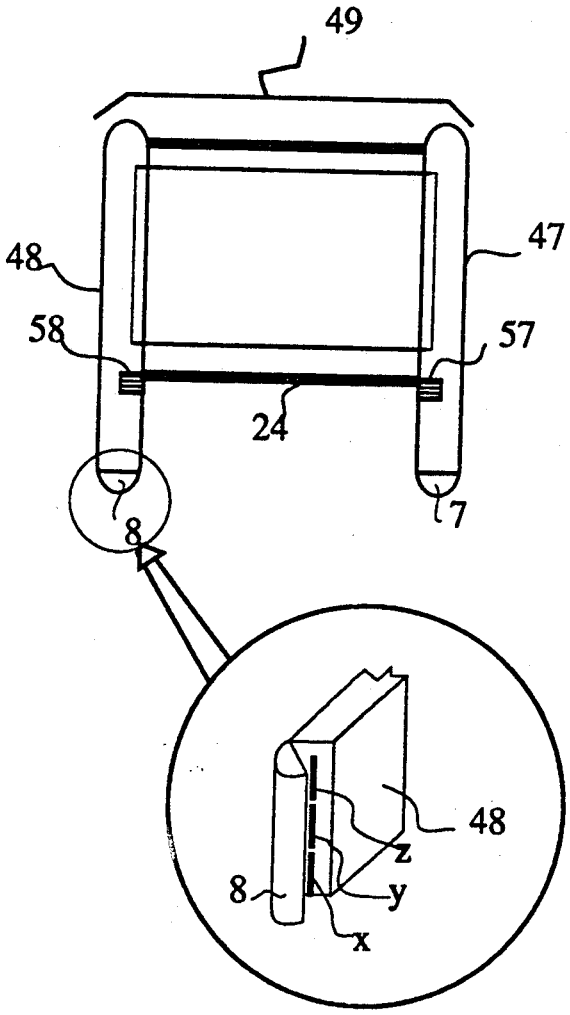

FIGS. 13 and 14 show how support towers 47, 48 form the fuselage 49 support. Left viewscreen basket pivot 55, together with right viewscreen basket pivot 23, hold viewscreen basket axle 56, which is preferably a hollow metal pipe to carry cables within its hollow. FIG. 14 shows right and left viewscreen basket axle journals 57 and 58. Door 8, shown partly opened in the inset, may contain slots x, y, z for disks or cassettes; such slots may also be placed elsewhere, for example in the face of the viewscreen basket adjacent the viewscreen.

FIG. 15 shows viewscreen basket 10, which has exoskeleton 27 hung on viewscreen basket axle 56. Exoskeleton 27 may be rolled at the edges 59 or braced if additional strength should be required, but its quarter-cylinder configuration and the thickness of its metal make exoskeleton virtually self-supporting. Axle 56 of course provides gravity support plus strength.

FIG. 16 shows frame and skin configurations of the viewscreen basket 10. Pipes 56 and 60 provide support for exoskeleton 27 of viewscreen basket 10. Axle 56 is longer than the width of the basket; pipe 60 serves as viewscreen basket frame member. Journals 57 and 58 (see FIG. 14) may be simple apertures in the support towers; there is no need for ball bearings because of the limited range and speed of rotation.

For repair or servicing, viewscreen basket 10 may be rotated fully above the fuselage and held by a safety bar. Alternatively, viewscreen basket 10 may be fully extended, unplugged, lifted totally out of the fuselage 49, and carried away. Standard protective measures, such as safety bar and electrical interlocks, are required for servicing.

FIGS. 17–19 show how a support tower (47 shown) includes an embedded slotted U-channel 61, or preferably, an integral slotted U-channel 62 stamped into its configuration. Appropriate U-channel grab hooks 63 on a right wing 4 can hold the wing without an underlying module box 52 (see FIG. 12) with a downward extension as shown in FIG. 18. FIG. 19 shows wing 4 with a module box 52; no downward extension is required.

FIG. 20 shows semi-diagrammatically how a variety of configurations of fuselage and wings, such as balanced wing configuration 64 and wing-to-wing unbalanced configuration 65, may be connected in a network via network cable 66. One or even several reveo units may be integrated into a large negotiating table 67, the units being connected together in a local network via cable 68, with individual units connected outside via secure individual lines. In negotiation embodiment, communication between units would normally be provided, with simultaneous or quick translation of audio, video and print, while secure individual facsimile and other communication would allow home office consultation during negotiations.

FIG. 21 is a schematic diagram of viewscreen top cover 3 and its positioning mechanism 69–73. Cover 3 protects the viewscreen from abrasion and spills and provides a writing surface over the joints between fuselage and wings and the joints between keyboard and viewscreen apron surface. Cover 3 is carried by nylon wires 69, each of which slides in a complementary groove in the desktop frame. The nylon wire is driven by a small DC torque motor and coupler, and is carried on a pulley system. Cover 3 is moved by nylon wires 69 pulled by reversible stepmotor driven pulley 70 which rotates pulley 71 which rotates roller 72. Roller 73 serves as supply and takeup roller. Crossed drive wire 74 provides the power from motor driven pulley 70 to the rollers. Inset in FIG. 21 is an expanded detail of the cover drive, showing how worktop cover drive wire 69 travels in channel 75 of the basket top frame (right frame 12 shown) to achieve snug fit for maximum protection and style.

Figure 22:
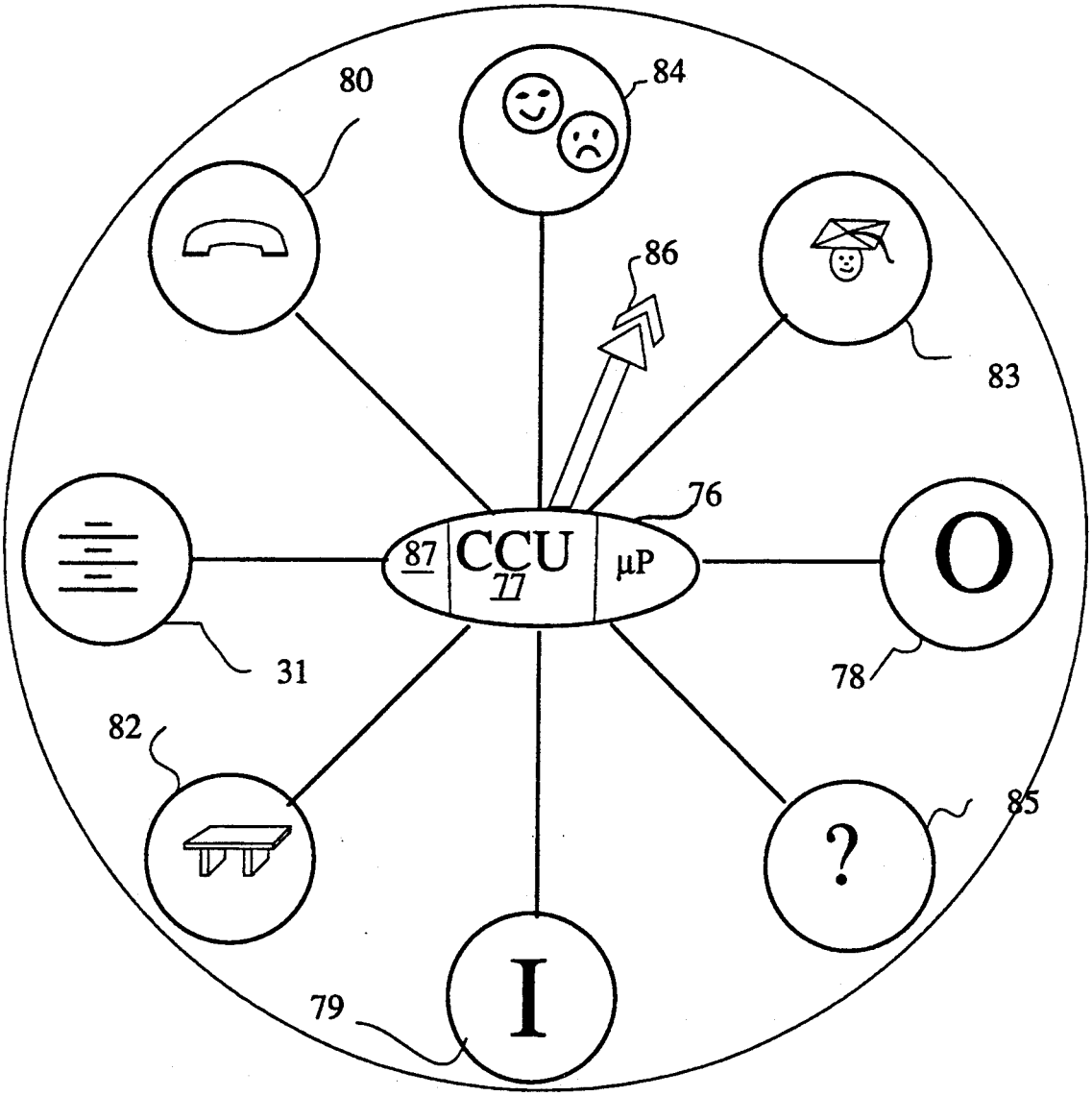
FIG. 22 is a system block diagram of functions of the reveo.

FIG. 22 is a system block diagram of functions of the reveo. The central control unit is a stored program computer. If capacity is sufficient, the computer may be a virtual computer performed by the shared computer in shared appliance support box 31, suitably programmed. A separate microprocessor 76 is preferred so that firmware for the central control unit may be factory installed and updated on a widespread basis. Central control unit 77 controls output function 78, input function 79, and other functions as follows:

| | | | |
|---|---|---|---|
| Communication | 80 | | |
| Business | 81 | 86 | Input |
| Desk | 82 | 87 | Output |
| Education | 83 | 88 | Writing |
| Entertainment | 84 | | |
| Miscellaneous | 85 | | |

Other functions are possible.

Umbilical 89 indicates a full set of connections to and from the reveo and the environment. Umbilical 89 normally comprises more than a simple bundle of cables; for example, a modem or set of modems are appropriate for the normal complement of appliances.

Figure 23:
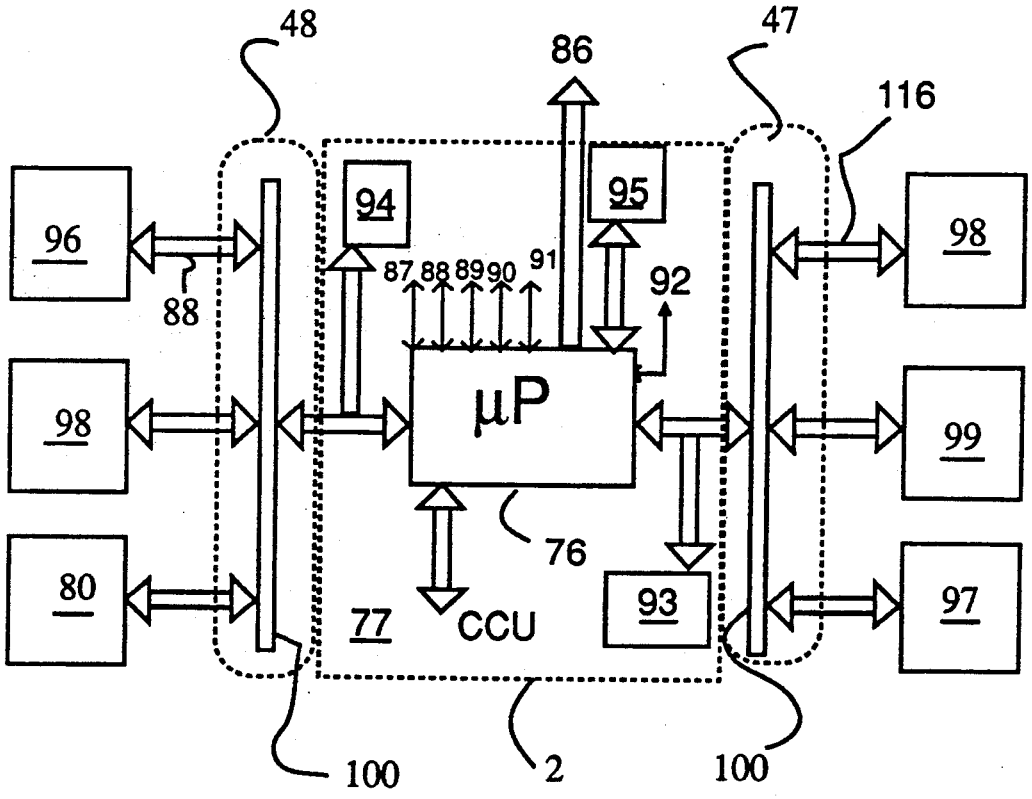
FIG. 23 is a schematic diagram of cable bus provision in the fuselage.

FIG. 23 is a schematic diagram of cable bus provision in the fuselage, showing the cable bus provision in the fuselage 49 and its support towers 47, 48. Power bus 90, data bus 91, communications bus 92, audio bus 93, video bus 94, ground bus 95 and control bus 96 complete the internal communications. Power bus 90 has appropriately fused AC power lines to provide AC for in-place and to-be-added embedded appliances, plus a small number of convenience outlets. Power bus 90 also has several appropriately fused and regulated DC lines. Fuses are accessible behind an inspection cover.

Data bus 91 has serial and parallel communications capability between embedded appliances, including a buffer unit 97 to handle discrepancies in data rates. Communications bus 92 integrates telephone lines available to the reveo by modem unit 98, line activator 99 and communications buffer 100. Telephone answering unit 101, facsimile unit 102 and communications control unit 103 help complete the communications capability. Umbilical 89 carries all power and external communication signals to and from workstation 1.

Audio bus 93 carries voice, music and other audio between microphone, telephone, annunciator, intercom, cassette, disk and stereo speakers.

Video bus 94 carries video signal between video cassette, disk, antenna cable and the viewscreen.

Ground bus 95 provides an affirmative wired ground for embedded appliances, other appliances and the table itself, for proper action of the appliances and for user safety.

Control bus 96 provides control signals from communications control unit 77 and from control microprocessor 76 to operate the various embedded appliances, available appliances, desk-top appliances, remote appliances and executive convenience features such as the viewscreen positioning mechanism.

FIG. 8, and FIG. 9 insets, show details of signal connection as well as positioning mechanism. The keyboard box 20 must not be damaged by multiple rotations. A data and power cord 38, preferred only if low cost is paramount, requires rotational discipline measures such as warnings or stops.

The expanded inset detail at top of FIG. 9 shows how an infra-red sender 100 and infra-red receiver 101 may be incorporated within the pivot 34 and either pivot slide 35 or frames 12, 13. Keyboard data may be sent by on/off sequences in series.

The detail at bottom of FIG. 9 shows an alternative keyboard data signal transfer mechanism involving pogo pins 102–105 and corresponding conductive collars 106–109, which may be sufficient in number to carry power and signal for the keyboard as well as attitude information relative to the appropriate frame 12, 13. Pin 106, for example, may carry serial signal data; pin 107 may carry power; and a set of pins (108, 109 shown) may carry relative position information as a function of the configuration of conductive lands coded for relative position.

METHOD OF OPERATION

In operation, the control microprocessor 76 is programmed with an operating system of a general nature, and with a user identifier personalized to the individual. After the boot, when the system is first turned on, the system prompts or otherwise verifies identification of the user and carries out the programmed startup chores.

Figure 24:
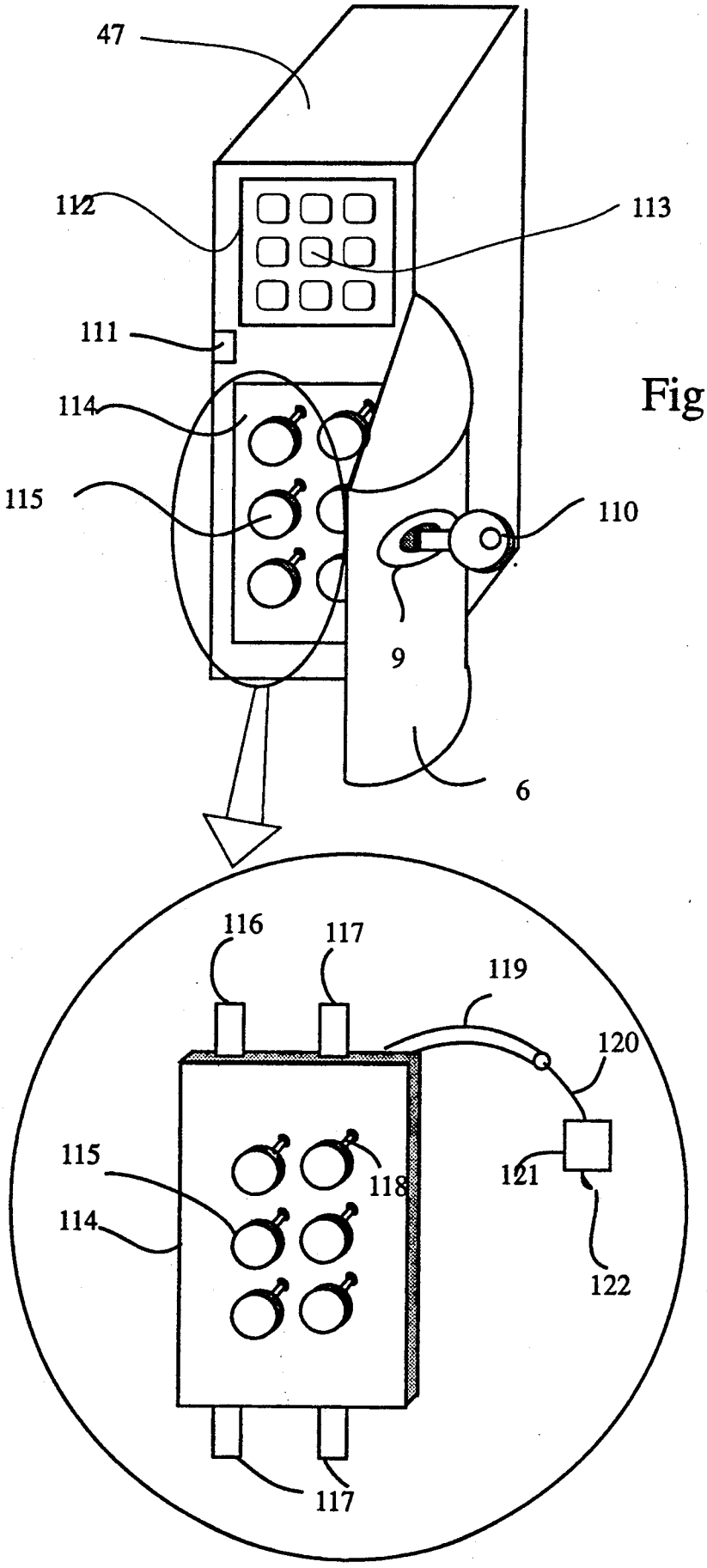
FIG. 24 is a semidiagrammatic presentation of the mechanical and power control lock system.

FIG. 24 is a semidiagrammatic presentation of the mechanical and power control lock system. Under certain circumstances, it is desired to lock access to all appliances and to disable all power—full security. In other circumstances, it is desired to lock access to certain appliances and permit access to others, with power available to a subset of appliances only. Such a situation might occur in a rental of less than all capability, or where a child might be permitted to use some but not all functions. Another situation might be the full access and full power availability for the field engineer to check out and service the appliances—even to disable certain interlocks for power on with covers open.

Key 110 opens the lock door, permitting it to swing free of latch 111. This exposes identification keyboard 112, at which the user may press a proper sequence of identification key buttons 113 to establish his identity.

Just below the identification keyboard is the cable lock unit 114, with its set of cable lock pulls including cable lock pull 115. The cable lock pull 115 is in turn lockable by a cable lock interposer 116 of cable lock interposer set 117. The cable lock interposers are subject to remote control by individual cable lock interposer catches which prevent the cable lock pulls from moving. Assuming that all authorizations are in place, and the cable lock interposers set to permit access, pulling on a cable lock pull such as 115 with respect to the related bowden cable 119 will move the related bowden wire 120 and open the related appliance access door latch 121. Appliance access door interlock switches such ass switch 122 applies power to a solenoid to move the related cable lock interposer. This permits a variety of locations to supply control signals to enable or disable the mechanical cable locks.

SUMMARY

The importance of position of viewscreen 11 must be emphasised. Overhead light may be a source of glare at one viewscreen attitude, but not at others. The user may be mostly working on the worktop, with minor interest in the viewscreen, in which case the viewscreen may be kept at a low angle. The user and another person may be working while standing, in which case the viewscreen 11 may be kept horizontal and viewed from above, perhaps even with overlying charts. The user may be doing interactive keying with strong emphasis on keyboard and viewscreen, and want the viewscreen fully extended to, or even past, the vertical, generally to the personalized favorite position. The user may wish to change the attitude of the viewscreen 11 from time to time, for viewing comfort or visual differences, or to ease neck and back muscles. Surprisingly, the viewer will probably want the keyboard fixed in three-dimensional space, at a small angle to the horizontal, at a fixed distance from the user's elbows and at just above elbow height—despite user-demanded changes in viewscreen attitude. Since the keyboard is mounted on the frames which carry the viewscreen, the keyboard attitude will normally require correction for each change in viewscreen attitude.

The initializing program, the bootstrap program or "boot", might be preprogrammed to position the viewscreen and keyboard to the preference of the user, and perhaps to show the schedule for the day's activity, according to the operating system program and the personalizing program. The user may include in the personalizing program a directive to retain keyboard attitude fixed despite changes in viewscreen attitude. This will require that any manual keyboard lock (32, FIG. 8) be released and the keyboard repositioned, either manually or automatically.

The operating system program includes an initializing program preset to generally acceptable norms, is set to identify the user and check the authorizations, and has capability of being personalized by a personalization program.

The method includes the following steps as a minimum:

1. Identify the user.
2. Check identification authorization.
3. Check for personalization.
4. Commence initialization as personalized.

The invention has been shown with manual setting of the keyboard relative position and viewscreen basket position; it has also been described with preset positioning of keyboard and viewscreen basket under manual entry of coordinates or computer entry of coordinates. These and other modifications and selections of features may be made by those skilled in the art within the spirit and scope of the invention, as defined in the following claims:

I claim:

1. A workstation comprising:

(a) a fuselage (49) providing gravity, power and signal support interface means for itself and modules (50–54), including at least a positionable retractable viewscreen basket (10) comprising viewscreen (11) and positionable retractable keyboard box (20), said viewscreen basket (10) and said keyboard box (20) being retractable with respect to said fuselage (49) to form a worktop (2), and being positionable with respect to said fuselage (49) to at least one non-horizontal position for operation;

(b) bus means (86–92) integral with said fuselage (49), connected with said interface means;

(c) control means (76–77) for the workstation (1);

(d) means (28–30) responsive to said control means (76–77) for extending said retractable viewscreen basket (10) to a preselectable viewing attitude for said viewscreen (11) with respect to said fuselage (49); and (e) means for detenting said positionable rotatable keyboard box (20) in a retracted postion and, alternatively, in a selected rotational attitude with respect to said viewscreen basket (20) for operation.

(f) means for detenting said positionable retactable keyboard in a retracted position and, alternately, in a selected rotational attitude for operation.

2. A workstation according to claim 1, in which said bus means integral with said fuselage (49) comprises at least one support tower (47–48) with gravity support means (61–62) for a related wing-module unit (4,5,50,52), plus umbilical means for at least one wing-module unit.

3. A workstation according to claim 2, in which said at least one support tower (47,48) comprises an exoskeleton enclosing an interior volume adapted for holding appliance hardware, said exoskeleton providing radiation shielding to the user as well as gravity support.

4. A workstation according to claim 1, in which said means for detenting comprises a set of slide pivots (34–36) to permit sliding of said keyboard box (20) as well as rotation.

5. A workstation according to claim 1, in which said means for detenting comprises a keyboard locking clutch (37) and co-acting manual keyboard detent lockscrew (32).

6. A workstation according to claim 1, in which said means for detenting comprises a spring ball on one member and a related arc of holes opposite said spring ball.

7. A workstation according to claim 1, in which said means for detenting comprises power means and power control means.

8. A workstation according to claim 7, in which said power control means comprises position monitoring means and means responsive to said position monitoring means to control said power means to move said keyboard box (20) to preset position coordinates.

9. A workstation according to claim 8, in which said position monitoring means is a step counter and said power means is a stepmotor.

10. A workstation according to claim 8, in which said position monitoring means records rotational position of said keyboard box (20) relative to said viewscreen basket (10) and said position monitoring means, concatenates relative coordinates of keyboard box (20) and viewscreen basket (10) to develop true coordinates, compares said true coordinates with coordinates selected for keyboard position, and provides to said means to control said power means a control signal to move said keyboard box (20) to a related set of relative coordinates.

11. A workstation according to claim 10, wherein said fuselage comprises a common appliance power converter (42) to provide power for a plurality of appliances via said bus means.

12. A workstation according to claim 1, comprising a subset of lockable appliance doors and access lock means having access control of said subset of appliance doors, and in addition having power control lock means for a subset of appliances.

13. A workstation according to claim 12, wherein said access lock means includes a lockable access lock door and comprises a set of wire cables with pull knobs located in a position made accessible by opening said access lock door, and wherein said power control lock means is also accessible by opening said access lock door.

14. A workstation according to claim 12, wherein said access lock means power control lock means includes a plurality of subsets selectively made operable by characteristics of a power control lock key.

15. A workstation according to claim 1, comprising a tower (47,48) having exoskeleton construction for providing both gravity support and radiation shielding.

16. A workstation according to claim 15, comprising a wing mountable on said tower.

17. A workstation according to claim 15, comprising a module mountable on said tower under said wing and providing gravity support to said wing.

18. A workstation according to claim 1, wherein said viewscreen basket comprises an exoskeleton enclosing a partial section of a cylinder providing both support and shielding.

19. A workstation according to claim 1, wherein said viewscreen basket comprises a hollow axle, a viewscreen top and a quarter-cylinder enclosure pivoted on said hollow axle.

20. A workstation according to claim 19, wherein said viewscreen basket axle is hollow and carries cables interconnecting said appliances and shared support members in said fuselage and said viewscreen basket.

21. A workstation according to claim 19, wherein said viewscreen basket axle is hollow and carries cables interconnecting said appliances and shared support members in said fuselage and said viewscreen basket with appliances carried in wing-module units.

22. A workstation according to claim 15, wherein said tower exoskeleton comprises an integral U-channel for attachment of items.

23. A workstation according to claim 1, connected in network configuration with another similar workstation.

24. A workstation according to claim 1, wherein said fuselage comprises bus means and connection means for attachment of additional appliances.

25. A workstation according to claim 1, wherein said control means includes limit detection means, to control a safety stop of said extending means upon detection of out-of-limit condition during a basket attitude change.

26. A workstation according to claim 22, wherein said control means includes desktop artifact detection means and means to prevent a viewscreen basket move upon detection of a desktop artifact atop the viewscreen basket.

27. A workstation comprising:

(a) a fuselage (49) providing gravity support, and providing energy and signal support interface means for itself and modules (52–54), including a positionable retractable viewscreen basket (10) comprising viewscreen (11) and positionable retractable keyboard box (20), said viewscreen basket (10) and said keyboard box (20) being retractable with respect to said fuselage (49) to form a worktop (2), and being positionable with respect to said fuselage (49) to at least one non-horizontal position for operation; p1 (b) control means (76–77) operatively associated with said fuselage (49);

(d) means (28–30) responsive to said control means (76–77) for extending said retractable viewscreen basket (10) to a preselectable viewing attitude with respect to said fuselage (49); and (e) means for detenting said positionable rotatable keyboard box (20) in a retracted position and, alternatively, in a selected rotational attitude with respect to said viewscreen basket (20) for operation.

28. A workstation according to claim 21, wherein said fuselage comprises a viewscreen top cover (3) and retraction means to position said viewscreen top cover (3) over said viewscreen (11).

29. A workstation according to claim 21, wherein said retraction means includes motor drive means (70) and pulley means (71) driven by said motor drive means so as to position said viewscreen cover (3) at a selected one of a plurality of positions with respect to said viewscreen (11).

30. A workstation according to claim 21, wherein said fuselage (49) comprises parallel framing members (12,13) framing viewscreen (11) and keyboard box (20), each framing member having a longitudinal channel (75), and wherein worktop cover drive wires (69) of said retraction means slide in such channels of said parallel framing members so as to provide a gapless and bumpless support to said viewscreen top cover (3).

31. A workstation according to claim 28, wherein said retraction means includes means to stop said retraction means upon detection of an out-of-limit condition during a cover move.

* * * * *